US006327865B1

(12) United States Patent
Bonaquist et al.

(10) Patent No.: US 6,327,865 B1
(45) Date of Patent: Dec. 11, 2001

(54) REFRIGERATION SYSTEM WITH COUPLING FLUID STABILIZING CIRCUIT

(75) Inventors: Dante Patrick Bonaquist, Grand Island; Kenneth Kai Wong, Amherst; Richard Amory Victor; Bayram Arman, both of Grand Island, all of NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 09/645,539

(22) Filed: Aug. 25, 2000

(51) Int. Cl.[7] ..... F25B 7/00

(52) U.S. Cl. ..... 62/79; 62/114; 62/512; 62/503; 62/502

(58) Field of Search ..... 62/114, 512, 503, 62/502, 79

(56) References Cited

U.S. PATENT DOCUMENTS

| | | | | |
|---|---|---|---|---|
| 5,327,741 | * | 7/1994 | Mason et al. | 62/149 |
| 5,524,442 | | 6/1996 | Bergman, Jr. et al. | 62/86 |
| 5,694,776 | | 12/1997 | Sahm | 62/63 |
| 5,718,116 | | 2/1998 | Grassi et al. | 62/62 |
| 6,041,620 | | 3/2000 | Olszewski et al. | 62/612 |
| 6,041,621 | | 3/2000 | Olszewski et al. | 62/613 |
| 6,044,660 | * | 4/2000 | Numoto et al. | 62/468 |
| 6,053,008 | * | 4/2000 | Arman et al. | 62/646 |
| 6,065,305 | | 5/2000 | Arman et al. | 62/613 |
| 6,076,372 | | 6/2000 | Acharya et al. | 62/606 |
| 6,112,550 | * | 9/2000 | Bonaquist et al. | 62/646 |

* cited by examiner

*Primary Examiner*—William Doerrler
*Assistant Examiner*—Mark Shulman
(74) *Attorney, Agent, or Firm*—Stanley Ktorides

(57) ABSTRACT

A refrigeration system wherein refrigeration is generated at a relatively steady output by a refrigeration circuit and passed into a coupling fluid for transfer to a refrigeration load using a coupling fluid stabilizing circuit having a stabilizing reservoir.

10 Claims, 2 Drawing Sheets

REFRIGERATION SYSTEM WITH COUPLING FLUID STABILIZING CIRCUIT

TECHNICAL FIELD

This invention relates generally to refrigeration and is particularly useful for use with refrigeration applications having unsteady requirements.

BACKGROUND ART

Refrigeration is an important utility for chemical, food and pharmaceutical manufacturing as well as other material processing industries. Generally refrigeration is generated using a vapor compression refrigeration circuit wherein a refrigerant fluid is compressed, cooled, expanded to generate refrigeration and then warmed to supply refrigeration to a refrigeration load.

While some refrigeration loads have a relatively unvarying refrigeration requirement, many refrigeration loads have refrigeration requirements which increase and decrease with time. In the interest of efficiency, it is desirable to vary the amount of refrigeration supplied to the refrigeration load to match the refrigeration requirements of refrigeration loads which have unsteady refrigeration requirements.

One way of addressing this problem is to adjust the refrigeration output of the refrigeration circuit by modulating the circulation rate of the refrigerant fluid within the refrigeration circuit. Unfortunately, refrigeration circuits are most efficient when operated continuously and at or near their maximum capacity. Another way of addressing this problem is to use a cryogenic liquid such as liquid nitrogen or liquid carbon dioxide to augment, as needed, the refrigeration provided by the refrigeration circuit to the refrigeration load. However, this expedient is quite costly owing to the costs of the cryogen.

Accordingly, it is an object of this invention to provide a system for efficiently providing refrigeration to a refrigeration load which has varying refrigeration requirements.

SUMMARY OF THE INVENTION

The above and other objects, which will become apparent to those skilled in the art upon a reading of this disclosure, are attained by the present invention, one aspect of which is:

A method for providing refrigeration to a refrigeration load comprising:

(A) compressing a refrigerant fluid, cooling the compressed refrigerant fluid, and expanding the cooled refrigerant fluid to generate refrigeration;

(B) warming the cooled refrigerant fluid by indirect heat exchange with a coupling fluid to produce warmed refrigerant fluid and cooled coupling fluid;

(C) warming the cooled coupling fluid to provide refrigeration to a refrigeration load; and (D) periodically passing some cooled coupling fluid into a stabilizing reservoir, and periodically passing some cooled coupling fluid from the stabilizing reservoir to the refrigeration load.

Another aspect of the invention is:

Apparatus for providing refrigeration to a refrigeration load comprising:

(A) a compressor, a refrigerant heat exchanger, an expansion device, means for passing refrigerant fluid from the compressor to the refrigerant heat exchanger, and means for passing refrigerant fluid from the refrigerant heat exchanger to the expansion device;

(B) a refrigeration load, a coupling fluid heat exchanger, and means for passing refrigerant fluid from the expansion device to the coupling fluid heat exchanger;

(C) means for passing coupling fluid from the coupling fluid heat exchanger to the refrigeration load, and means for passing coupling fluid from the refrigeration load to the coupling fluid heat exchanger; and (D) a stabilizing reservoir, means for passing coupling fluid from the coupling fluid heat exchanger into the stabilizing reservoir, and means for passing coupling fluid from the stabilizing reservoir to the refrigeration load.

As used herein, the term "indirect heat exchange" means the bringing of two fluids into heat exchange relation without any physical contact or intermixing of the fluids with each other.

As used herein, the term "expansion" means to effect a reduction in pressure.

As used herein, the term "expansion device" means apparatus for effecting expansion of a fluid.

As used herein, the term "compressor" means apparatus for effecting compression of a fluid.

As used herein, the term "multicomponent refrigerant fluid" means a fluid comprising two or more species and capable of generating refrigeration.

As used herein, the term "refrigeration" means the capability to reject heat from a subambient temperature system.

As used herein, the terms "turboexpansion" and "turboexpander" mean respectively method and apparatus for the flow of high pressure fluid through a turbine to reduce the pressure and the temperature of the fluid thereby generating refrigeration.

As used herein, the term "refrigerant fluid" means a pure component or mixture used as a working fluid in a refrigeration process which undergoes changes in temperature, pressure and possibly phase to absorb heat at a lower temperature and reject it at a higher temperature.

As used herein, the term "variable load refrigerant" means a mixture of two or more components in proportions such that the liquid phase of those components undergoes a continuous and increasing temperature change between the bubble point and the dew point of the mixture. The bubble point of the mixture is the temperature, at a given pressure, wherein the mixture is all in the liquid phase but addition of heat will initiate formation of a vapor phase in equilibrium with the liquid phase. The dew point of the mixture is the temperature, at a given pressure, wherein the mixture is all in the vapor phase but extraction of heat will initiate formation of a liquid phase in equilibrium with the vapor phase. Hence, the temperature region between the bubble point and the dew point of the mixture is the region wherein both liquid and vapor phases coexist in equilibrium. In the preferred practice of this invention the temperature differences between the bubble point and the dew point for a variable load refrigerant generally is at least 10° C., preferably at least 20° C., and most preferably at least 50° C.

As used herein, the term "refrigeration load" means a stream or object that requires a reduction in energy, or removal of heat, to lower its temperature.

DETAILED DESCRIPTION

Figure 1:
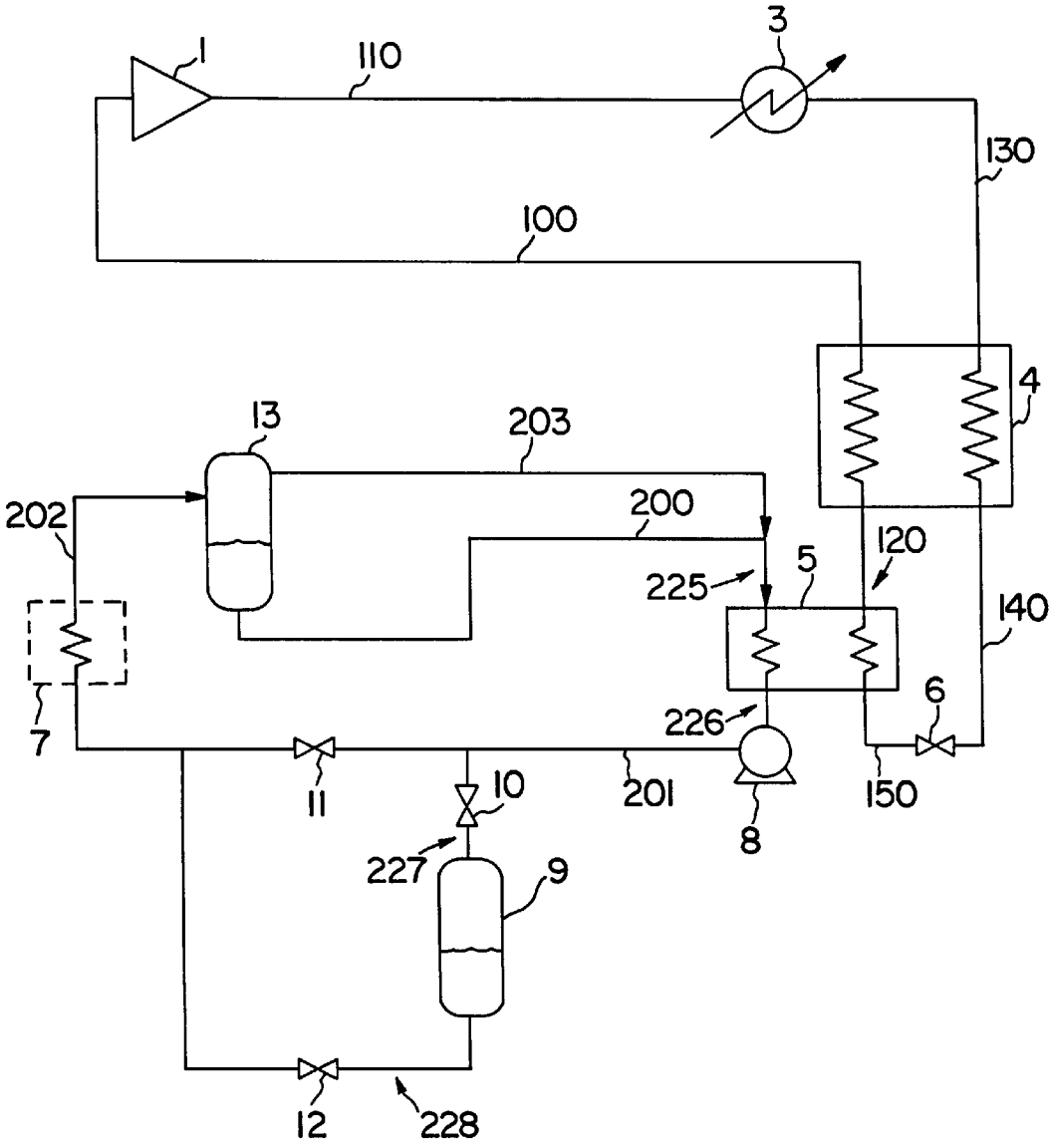
FIG. 1 is a schematic representation of one preferred embodiment of the invention wherein the refrigeration circuit employs valve expansion to generate the refrigeration.

The invention will be described in detail with reference to the Drawings. Referring now to FIG. 1, refrigerant fluid 100 is compressed by passage through compressor 1 to a pressure generally within the range of from 30 to 1000 pounds per square inch absolute (psia). Resulting compressed refrigerant fluid 110 is cooled of the heat of compression in cooler 3 and may be partially condensed, and then passed in stream 130 to refrigerant heat exchanger 4. Within refrigerant heat exchanger 4 the refrigerant fluid is cooled by indirect heat exchange with warming refrigerant fluid as will be further described below, and may be completely condensed. The resulting cooled refrigerant fluid is withdrawn from refrigerant heat exchanger 4 and passed in stream 140 to an expansion device, which in the embodiment of the invention illustrated in FIG. 1, is Joule-Thompson throttle valve 6. The refrigerant fluid is expanded by passage through the expansion device to generate refrigeration. Resulting refrigeration bearing refrigerant fluid 150, which is generally a two-phase fluid, is passed to coupling fluid heat exchanger 5 wherein it is warmed by indirect heat exchanger with coupling fluid as will be more fully described below. The resulting warmed refrigerant fluid, generally having a larger vapor phase than when it entered heat exchanger 5, is passed from coupling fluid heat exchanger 5 to refrigerant heat exchanger 4 in stream 120. Within refrigerant heat exchanger 4 the warmed refrigerant fluid is further warmed and generally totally vaporized by indirect heat exchange to effect the cooling of the refrigerant fluid as was previously described. The resulting further warmed refrigerant fluid is withdrawn from refrigerant heat exchanger 4 and passed in stream 100 to compressor 1 to complete the refrigeration circuit.

Any effective refrigerant fluid may be used in the practice of this invention. Examples include ammonia, R-410A, R-507A, R-134A, propane, R-23 and mixtures such as mixtures of fluorocarbons, hydrofluorocarbons, hydrochlorofluorocarbons, atmospheric gases and/or hydrocarbons.

Preferably the refrigerant fluid used in the practice of this invention is a multicomponent refrigerant fluid which is capable of more efficiently delivering refrigeration at different temperature levels. When a multicomponent refrigerant fluid is used in the practice of this invention it preferably comprises at least two species from the group consisting of fluorocarbons, hydrofluorocarbons, hydrochlorofluorocarbons, fluoroethers, atmospheric gases and hydrocarbons, e.g. the multicomponent refrigerant fluid could be comprised only of two fluorocarbons. Preferably the multicomponent refrigerant useful in the practice of this invention is a variable load refrigerant.

One preferred multicomponent refrigerant useful with this invention preferably comprises at least one component from the group consisting of fluorocarbons, hydrofluorocarbons, and fluoroethers, and at least one component from the group consisting of fluorocarbons, hydrofluorocarbons, hydrochlorofluorocarbons, fluoroethers, atmospheric gases and hydrocarbons.

In one preferred embodiment of the invention the multicomponent refrigerant consists solely of fluorocarbons. In another preferred embodiment of the invention the multicomponent refrigerant consists solely of fluorocarbons and hydrofluorocarbons. In another preferred embodiment of the invention the multicomponent refrigerant consists solely of fluorocarbons, fluoroethers and atmospheric gases. Most preferably every component of the multicomponent refrigerant is either a fluorocarbon, hydrofluorocarbon, fluoroether or atmospheric gas.

Coupling fluid 225 is passed into coupling fluid heat exchanger 5 wherein it is cooled by indirect heat exchange with the warming refrigerant fluid as was previously. Resulting cooled coupling fluid 226, which is typically in liquid form, is pumped through pump 8 in stream 201 through valve 11 to refrigeration load 7 wherein the coupling fluid is warmed to provide refrigeration to the refrigerant load. The heat transfer could be by indirect heat exchange or could be by direct contact. The refrigeration load could comprise a single entity or could comprise a plurality of discrete entities. Refrigeration loads can range from fractions of a refrigeration ton (12,000 BTU/hr) up to thousands of refrigeration tons.

The invention is characterized by a coupling fluid stabilizing circuit which includes stabilizing reservoir 9. When the refrigeration requirements of the refrigeration load are about equal to the refrigeration output efficiently produced by the refrigeration circuit, valves 10 and 12 of the stabilizing circuit are closed, valve 11 is open and cooled coupling fluid flows in line 201 to refrigeration load 7 as was described above. If the refrigeration requirements of the refrigeration load drop below the efficient refrigeration output of the refrigeration circuit, rather than operating the refrigeration circuit in an inefficient subcapacity mode, the refrigeration circuit operation is maintained in the high capacity efficient mode, valve 11 is partially closed and valve 10 is at least partially opened, thereby diverting some of the cooled coupling fluid into stabilizing reservoir 9 by means of line 227. If the refrigeration requirements of the refrigeration load were to increase so as to be greater than the efficient capacity of the refrigeration circuit, valve 12 would be opened and cooled coupling fluid would pass from stabilizing reservoir 9 through line 228 and valve 12 to the refrigeration load as well as through valve 11. In the event stabilizing reservoir 9 were to become filled to capacity, valve 10 would be closed, valve 12 would be opened and some of the refrigeration requirements of refrigeration load 7 would be supplied from the stabilizing reservoir until the liquid level in reservoir 9 dropped to nominal. Although the coupling fluid stabilizing circuit depicted in FIG. 1 is shown as having its input and output connecting with the main line passing cooled coupling fluid to the refrigeration load, those skilled in the art will recognize that the coupling fluid stabilizing circuit could connect directly with coupling fluid heat exchanger 5 and/or refrigeration load 7. As will be recognized by those skilled in the art the passing of cooled coupling fluid into the stabilizing reservoir is periodic, i.e. intermittent, and the passing of cooled coupling fluid from the stabilizing reservoir to the refrigeration load is also periodic. The periods of inflow into the stabilizing reservoir may be of the same duration or of different durations, and may be in a pattern or may be completely random, and the same is true of the periods of outflow from the stabilizing reservoir.

Referring back now to FIG. 1, preferably the warmed coupling fluid in stream 202 is completely vaporized by the heat exchange with the refrigeration load. In any event stream 202 is passed to surge drum 13 wherein any remaining liquid in stream 202 is allowed to accumulate so as to not overload the system when the refrigeration requirements of the refrigeration load are particularly low. Vapor coupling fluid is passed out of surge drum 13 in stream 203 and liquid coupling fluid is passed out of surge drum 13 in stream 200. These two streams are combined to form stream 225 for passage to coupling fluid heat exchanger 5 to complete this circuit. Preferably the coupling fluid useful in the practice of this invention has low viscosity, high thermal conductivity, high sensible heat and a low freezing point. In addition, it is preferred that it be non-corrosive, inert and non-toxic.

Examples of useful coupling fluids which may be used in the practice of this invention include fluorocarbons such as $C_5F_{12}$ and $C_6F_{14}$, hydrofluorocarbons such as $C_5H_2F_{10}$, $C_3H_3F_5$, $C_4H_4F_6$, $C_4H_5F_5$ and $C_3H_2F_6$, hydrochlorofluorocarbons such as $C_3HCl_2F_5$, $C_2HCl_2F_3$ and $C_2HClF_4$, hydrofluoroethers such as $C_4F_9$—O—$C_2H_5$, $C_4F_9$—O—$CH_3$, and $C_3F_7$—O—$CH_3$, and hydrocarbons such as $C_7H_{16}$, $C_6H_{14}$ and $C_5H_{12}$, as well as miscible mixtures of any close boiling of these components, and azeotropic mixtures of these components such as the binary fluid of $C_4F_9$—O—$C_2H_5$ with $C_4F_9$—O—$CH_3$, and the binary fluid $C_4F_9$—O—$C_2H_5$ with $C_2HClF_4$.

Figure 2:
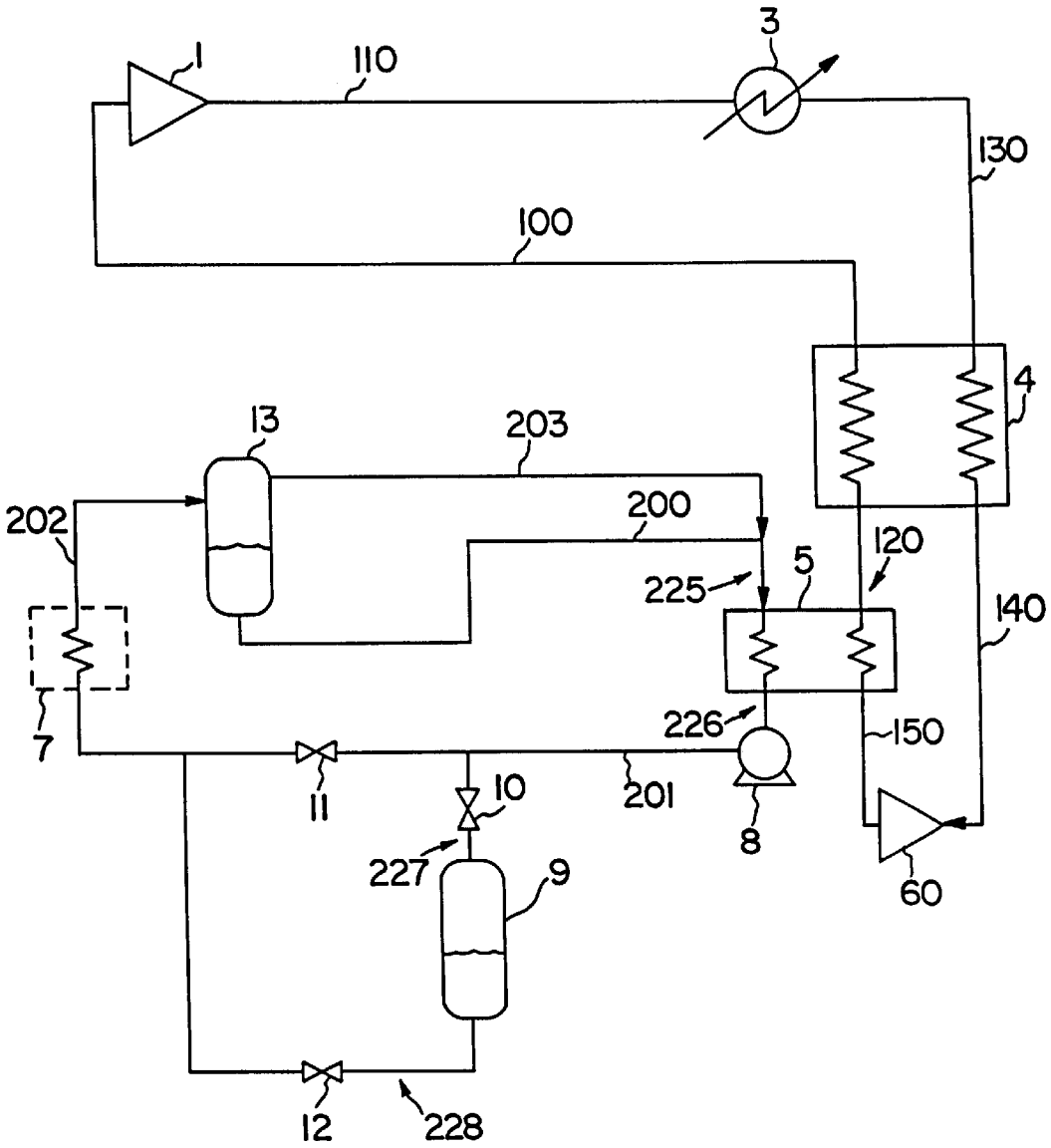
FIG. 2 is a schematic representation of another preferred embodiment of the invention wherein the refrigeration circuit employs turboexpansion to generate the refrigeration.

FIG. 2 illustrates another embodiment of the invention. The numerals in FIG. 2 are the same as those of FIG. 1 for the common elements, and these common elements will not be discussed again in detail. In the embodiment illustrated in FIG. 2 cooled refrigerant fluid 140 is turboexpanded by passage through turboexpander 60 to generate refrigeration and to form low pressure gas 150. The turboexpansion typically generates more refrigeration than the valve expansion discussed in connection with the embodiment illustrated in FIG. 1. The work of expansion derived from turboexpander 60 must be dissipated. This can be accomplished by any suitable loading device such as a brake, compressor or generator. Devices that recover the expansion work in a useful manner are preferred.

Although the invention has been described in detail with reference to certain preferred embodiments, those skilled in the art will recognize that there are other embodiments of the invention within the spirit and the scope of the claims.

What is claimed is:

1. A method for providing refrigeration to a refrigeration load comprising:

(A) compressing a refrigerant fluid, cooling the compressed refrigerant fluid, and expanding the cooled refrigerant fluid to generate refrigeration;

(B) warming the cooled refrigerant fluid by indirect heat exchange with a coupling fluid to produce warmed refrigerant fluid and cooled coupling fluid;

(C) warming the cooled coupling fluid to provide refrigeration to a refrigeration load; and (D) periodically passing some cooled coupling fluid into a stabilizing reservoir, and periodically passing some cooled coupling fluid from the stabilizing reservoir to the refrigeration load.

2. The method of claim 1 wherein the refrigerant fluid is a multicomponent refrigerant fluid.

3. The method of claim 2 wherein the refrigerant fluid is a variable load refrigerant.

4. The method of claim 2 wherein the refrigerant fluid comprises at least two species from the group consisting of fluorocarbons, hydrofluorocarbons, hydrochlorofluorocarbons, fluoroethers, atmospheric gases and hydrocarbons.

5. The method of claim 1 wherein the coupling fluid is a mixture comprising at least two components.

6. Apparatus for providing refrigeration to a refrigeration load comprising:

(A) a compressor, a refrigerant heat exchanger, an expansion device, means for passing refrigerant fluid from the compressor to the refrigerant heat exchanger, and means for passing refrigerant fluid from the refrigerant heat exchanger to the expansion device;

(B) a refrigeration load, a coupling fluid heat exchanger, and means for passing refrigerant fluid from the expansion device to the coupling fluid heat exchanger;

(C) means for passing coupling fluid from the coupling fluid heat exchanger to the refrigeration load, and means for passing coupling fluid from the refrigeration load to the coupling fluid heat exchanger; and (D) a stabilizing reservoir, means for passing coupling fluid from the coupling fluid heat exchanger into the stabilizing reservoir, and means for passing coupling fluid from the stabilizing reservoir to the refrigeration load.

7. The apparatus of claim 6 wherein the expansion device is an expansion valve.

8. The apparatus of claim 6 wherein the expansion device is a turboexpander.

9. The apparatus of claim 6 further comprising means for passing refrigerant fluid from the coupling fluid heat exchanger to the refrigerant heat exchanger, and means for passing refrigerant fluid from the refrigerant heat exchanger to the compressor.

10. The apparatus of claim 6 wherein the means for passing coupling fluid from the refrigeration load to the coupling fluid heat exchanger includes a surge drum.

* * * * *